US008118951B2

(12) United States Patent
Uesugi et al.

(10) Patent No.: US 8,118,951 B2
(45) Date of Patent: Feb. 21, 2012

(54) ALUMINUM ALLOY SHEET FOR LITHOGRAPHIC PRINTING PLATE

(75) Inventors: Akio Uesugi, Shizuoka (JP); Atsushi Matsuura, Shizuoka (JP); Hiroshi Ougi, Tokyo (JP); Atsushi Hibino, Tokyo (JP)

(73) Assignees: Fujifilm Corporation, Minato-Ku, Tokyo (JP); Sumitomo Light Metal Industries, Ltd., Minato-Ku, Tokyo (JP)

( * ) Notice: Subject to any disclaimer, the term of this patent is extended or adjusted under 35 U.S.C. 154(b) by 0 days.

(21) Appl. No.: 12/590,032

(22) Filed: Oct. 30, 2009

(65) Prior Publication Data

US 2011/0104001 A1 May 5, 2011

(51) Int. Cl.
*C22C 21/00* (2006.01)

(52) U.S. Cl. ..... 148/440; 420/544; 420/547; 420/551

(58) Field of Classification Search ..... 148/437–440; 420/544, 547, 551

See application file for complete search history.

(56) References Cited

U.S. PATENT DOCUMENTS

| | | | |
|---|---|---|---|
| 6,194,082 | B1 | 2/2001 | Sawada et al. |
| 2005/0013724 | A1 | 1/2005 | Ougi et al. |

FOREIGN PATENT DOCUMENTS

| | | | |
|---|---|---|---|
| JP | 03177528 | A * | 8/1991 |
| JP | 11-335761 | | 12/1999 |
| JP | 11335761 | A * | 12/1999 |
| JP | 2000-108534 | | 4/2000 |
| JP | 2004-035936 | | 2/2004 |
| JP | 2005-015912 | | 1/2005 |

* cited by examiner

*Primary Examiner* — Roy King

*Assistant Examiner* — Janelle Morillo

(74) *Attorney, Agent, or Firm* — Flynn, Thiel, Boutell & Tanis, P.C.

(57) ABSTRACT

An aluminum alloy sheet for a lithographic printing plate includes 0.03 to 0.15% (mass %, hereinafter the same) of Si, 0.2 to 0.7% of Fe, 0.05 to 0.5% of Mg, 0.003 to 0.05% of Ti, and 30 to 300 ppm of Ga, with the balance being aluminum and inevitable impurities, a surface area of the aluminum alloy sheet having an average recrystallized grain size of 50 μm or less in a direction perpendicular to a rolling direction, an Mg concentration that is higher than the average Mg concentration by a factor of 5 to 50, and a Ga concentration that is higher than the average Ga concentration by a factor of 2 to 20, the surface area being an area up to a depth of 0.2 μm from the surface of the aluminum alloy sheet.

4 Claims, 1 Drawing Sheet

ALUMINUM ALLOY SHEET FOR LITHOGRAPHIC PRINTING PLATE

BACKGROUND OF THE INVENTION

The present invention relates to an aluminum alloy sheet for a lithographic printing plate. More particularly, the present invention relates to an aluminum alloy sheet for a lithographic printing plate that may be suitably surface-roughened by an electrochemical etching treatment and ensures a high productivity.

An aluminum alloy sheet is generally used as a support for a lithographic printing plate (including an offset printing plate). An aluminum alloy sheet used as such a support is surface-roughened in order to improve its adhesion to a photosensitive film and improve the water retention in a non-image area. In recent years, a method that roughens the surface of an aluminum alloy sheet used as a support by an electrochemical etching treatment has been increasingly developed due to excellent plate-making applicability (fitness), excellent printing performance and a continuous treatment capability using a coil material.

As an aluminum alloy sheet that can be relatively uniformly surface-roughened by electrolysis using an electrochemical etching treatment, an A1050 (aluminum purity: 99.5%) equivalent material or a material obtained by adding small amounts of alloy components to an A1050 equivalent material has been utilized. Several proposals have been made on such alloy components (see JP-A-2000-108534, for example).

In order to improve the plate wear of a printing plate, a printing plate using an aluminum alloy sheet as a support is subjected to exposure and development using a normal method, followed by a high-temperature heat treatment (burning treatment) to strengthen the image area. The burning treatment is generally performed at 200 to 290° C. for 3 to 9 minutes. An aluminum alloy sheet used as a support is required to exhibit heat resistance (burning resistance) which maintains the strength of the support during the burning treatment.

In recent years, the printing speed has increased along with the progress in printing technology so that stress applied to a printing plate mechanically secured on each side of a plate cylinder of a printer has increased. Therefore, a support having a high strength has been desired. If the strength of the support is insufficient, the secured portion of the support may be deformed or damaged, so that a printing variation or the like may occur. Accordingly, an increase in strength of the support is indispensable together with the burning resistance.

In order to satisfy the above requirements, attempts have been made to adjust the components added to an A1050 equivalent material (see JP-A-2005-15912). Attempts have also been made to adjust the components added to an A1050 equivalent material while adjusting the depth of oil pits in the sheet surface (see JP-A-2004-35936).

Such an aluminum alloy material for a lithographic printing plate has been produced by homogenizing an ingot, hot-rolling the homogenized product, cold-rolling the hot-rolled product while performing process annealing to form a recrystallized structure on the surface of the rolled sheet, and subjecting the cold-rolled product to secondary cold-rolling, thereby ensuring uniform pit formation during an electrochemical etching treatment and preventing streaks when forming a printing plate. However, since a decrease in productivity and an increase in production cost necessarily occur due to process annealing, an improved production method has been desired.

A method that obtains an aluminum alloy sheet for a lithographic printing plate by cold-rolling a hot-rolled product without performing process annealing has been proposed (see JP-A-11-335761). In this method, hot-rolling includes rough hot-rolling and finish hot-rolling. The rough hot-rolling start temperature is set at 450° C. or more. An aluminum alloy is subjected to rough hot-rolling at a rolling speed of 50 m/min or more, and a rolling reduction of 30 mm or more or a single-pass rolling reduction ratio of 30%. The rough hot-rolling finish temperature is set at 300 to 370° C. The finish hot-rolling finish temperature is set at 280° C. or more. The rolled product is then wound in the shape of a coil to control the recrystallization state of the surface of the sheet.

In order to omit process annealing, it is necessary that an aluminum alloy sheet has been recrystallized when wound in the shape of a coil after finish hot-rolling. In order to obtain uniform electrolytic surface-roughening characteristics, it is important that recrystallized grains are minute and uniform in the same manner as in a material subjected to process annealing, and the surface area of the sheet is uniformly recrystallized.

SUMMARY OF THE INVENTION

In order to obtain an aluminum alloy material for a lithographic printing plate that allows the formation of more uniform and minute pits by electrolysis, the inventors of the present invention conducted studies on the composition and the structure of the above material. As a result, the inventors found that it is effective to use a material that contains Mg and Ga, wherein the Mg and Ga concentrations in the surface area are higher than the Mg and Ga concentrations in an area deeper than the surface area. The inventors also found that it is important to control the rough hot-rolling start temperature, the holding time from completion of rough hot-rolling to finish hot-rolling, and the finish hot-rolling finish temperature in order to produce an aluminum alloy sheet having the above structure without performing process annealing.

The present invention was conceived as a result of further tests and studies based on the above findings. An object of the present invention is to provide an aluminum alloy sheet for a lithographic printing plate that ensures that the surface of the sheet is uniformly recrystallized with minute and uniform recrystallized grains when the sheet is wound in the shape of a coil after finish hot-rolling, can be cold-rolled to a desired thickness without performing process annealing after hot-rolling, achieves appropriate Mg and Ga concentrations in the surface area, ensures that minute pits are uniformly formed during an electrochemical etching treatment and streaks do not occur when forming a printing plate, and exhibits excellent strength.

An aluminum alloy sheet for a lithographic printing plate according to a first aspect of the present invention that achieves the above object comprises 0.03 to 0.15% of Si, 0.2 to 0.7% of Fe, 0.05 to 0.5% of Mg, 0.003 to 0.05% of Ti, and 30 to 300 ppm of Ga, with the balance being aluminum and unavoidable impurities, a surface area of the aluminum alloy sheet having an average recrystallized grain size of 50 μm or less in a direction perpendicular to a rolling direction, an Mg concentration that is higher than the average Mg concentration by a factor of 5 to 50, and a Ga concentration that is higher than the average Ga concentration by a factor of 2 to 20, the surface area being an area up to a depth of 0.2 μm from the surface of the aluminum alloy sheet.

The above aluminum alloy sheet may further comprise 0.05% or less of Cu.

In the above aluminum alloy sheet, the content of Mg that precipitates in the matrix of the aluminum alloy sheet may be 50% or less of the average Mg concentration.

The above aluminum alloy sheet may have a tensile strength of 190 MPa or more.

According to the present invention, an aluminum alloy sheet for a lithographic printing plate that ensures that the surface of the sheet is uniformly recrystallized with minute and uniform recrystallized grains when the sheet is wound in the shape of a coil after finish hot-rolling, can be cold-rolled to a desired thickness without performing process annealing after hot-rolling, achieves appropriate Mg and Ga concentrations in the surface area, ensures that minute pits are uniformly formed during an electrochemical etching treatment and streaks do not occur when forming a printing plate, and exhibits excellent strength, can be provided.

DESCRIPTION OF EXEMPLARY EMBODIMENTS

Figure 1:
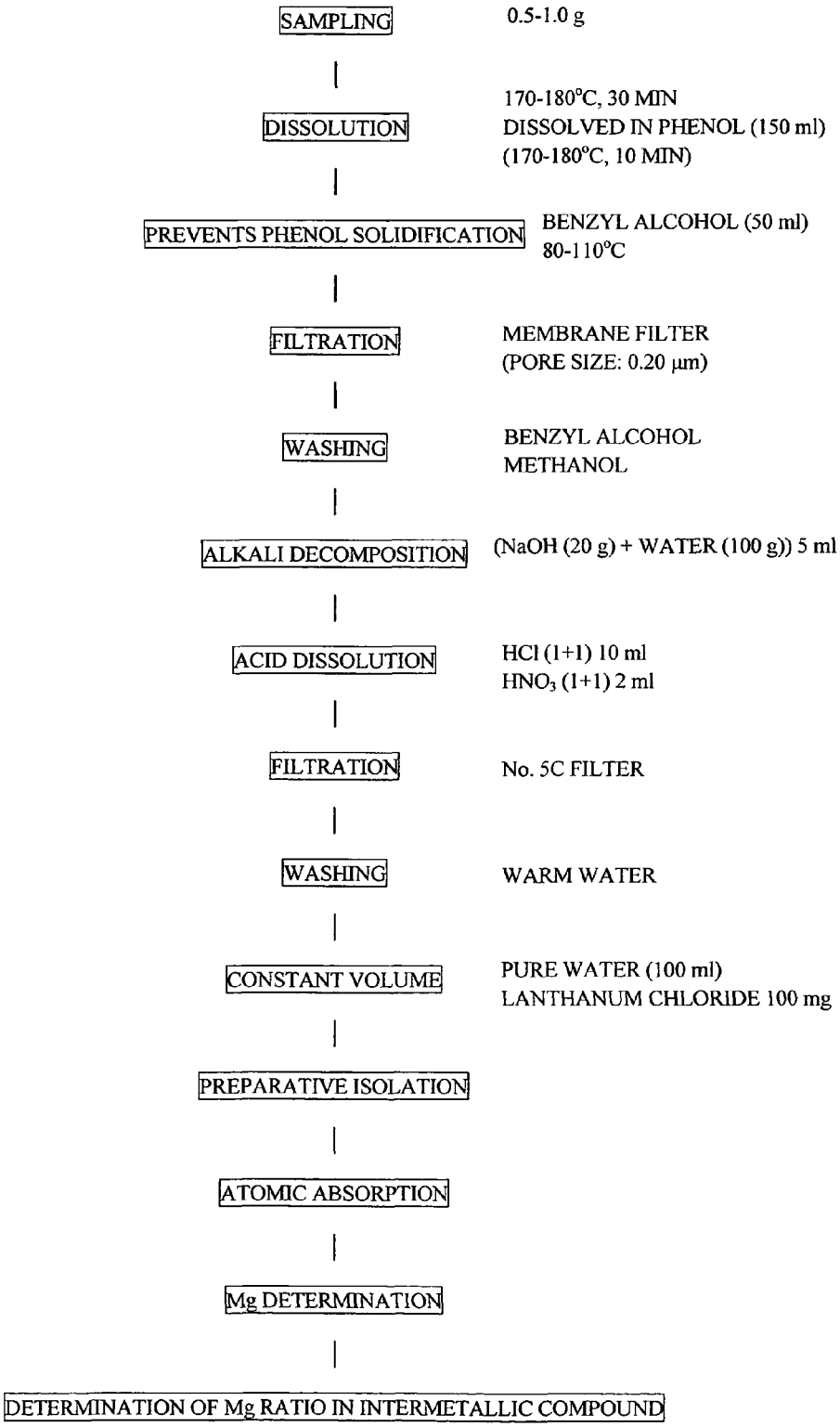
FIG. 1 is a flowchart showing an Mg precipitation rate measurement method.

The meanings of and the reasons for limitations to the components of the aluminum alloy sheet for a lithographic printing plate according to the present invention are described below. Si produces Al—Fe—Si intermetallic compounds together with Fe. These compounds are dispersed to refine the recrystallization structure. These compounds serve as pit formation starting points so that the pits are uniformly formed and are finely distributed during electrolysis. The Si content is preferably 0.03 to 0.15%. If the Si content is less than 0.03%, the distribution of the compounds may become non-uniform so that an unetched area may occur during electrolysis. As a result, the formation of pits may become non-uniform. If the Si content exceeds 0.15%, coarse compounds may be produced. Moreover, precipitation of Si tends to occur, whereby the uniformity of the surface-roughened structure may decrease.

Fe produces Al—Fe intermetallic compounds and also produces Al—Fe—Si intermetallic compounds together with Si. These compounds are dispersed to refine the recrystallization structure. These compounds serve as pit formation-starting points so that the pits are uniformly formed and finely distributed during electrolysis. The Fe content is preferably 0.2 to 0.7%. If the Fe content is less than 0.2%, the distribution of the compounds may become non-uniform so that an unetched area may occur during electrolysis. As a result, the formation of the pits may become non-uniform. If the Fe content exceeds 0.7%, coarse compounds may be produced so that the uniformity of the surface-roughened structure may deteriorate.

Most Mg is dissolved in aluminum to increase its strength and thermal softening resistance. Mg forms Mg—Si compounds ($Mg_2Si$) and suppresses the precipitation of Si that decreases the uniformity of the surface-roughened structure. The term "strength" used herein refers to the tensile strength of a printing plate support at room temperature. The term "thermal softening resistance" (also referred to as "burning resistance") refers to 0.2% proof stress after heating at about 280° C. The thermal softening resistance is preferably 90 MPa or more in practical applications. The Mg content is preferably 0.05 to 0.5%. If the Mg content is less than 0.05%, the effect is insufficient. If the Mg content exceeds 0.5%, $Mg_2Si$ precipitates to a large extent so that the surface quality decreases. The Mg content is more preferably 0.06% or more and less than 0.10%.

An aluminum alloy containing Mg tends to produce an oxide film mainly formed of an Mg oxide (MgO) during a heat treatment such as heating during homogenization or hot-rolling. Since such an oxide film is active and porous, wettability with a treatment liquid is improved during an electrolytic surface-roughening treatment so that surface roughening is promoted. In order to obtain the above effect, it is preferable that the surface area of the aluminum alloy sheet have an Mg concentration that is higher than the average Mg concentration by a factor of 5 to 50, the surface area being an area up to a depth of 0.2 μm from the surface of the aluminum alloy sheet. If the surface area has an Mg concentration that is higher than the average Mg concentration by a factor of more than 50, surface roughening proceeds to a large extent so that the pits may become non-uniform.

Mg dissolved in aluminum promotes surface roughening. Precipitation of Mg—Si compounds ($Mg_2Si$) suppresses the precipitation of Si that decreases the uniformity of the surface-roughened structure. The content of Mg that precipitates in the matrix of the aluminum alloy sheet is preferably 50% or less of the average Mg concentration. If dissolution and precipitation of Mg satisfy the above range, surface roughening can be advantageously achieved.

Ti refines the ingot structure and the crystal grains. As a result, Ti ensures uniform pit formation during electrolysis to prevent streaks that may occur when forming a printing plate. The Ti content is preferably 0.003 to 0.05%. If the Ti content is less than 0.003%, Ti may not exhibit a sufficient effect. If the Ti content exceeds 0.05%, coarse Al—Ti compounds may be produced so that the surface-roughened structure tends to become non-uniform. When adding B together with Ti in order to refine the ingot structure, the Ti content is preferably 0.01% or less.

Ga is concentrated in the surface area and makes the pits minute during electrolysis to improve the pit formation uniformity. This enables the desired pit pattern to be obtained. The Ga content is preferably 30 to 300 ppm. If the Ga content is less than 30 ppm, Ga may not exhibit a sufficient effect. If the Ga content exceeds 300 ppm, the surface-roughened structure may become non-uniform. It is preferable that the surface area of the aluminum alloy sheet up to a depth of 0.2 μm from the surface of the aluminum alloy sheet have a Ga concentration that is higher than the average Ga concentration by a factor of 2 to 20.

Cu is easily dissolved in aluminum. When the Cu content is 0.05% or less, Cu exhibits a pit refinement effect. If the Cu content exceeds 0.05%, the pits may become large and non-uniform during electrolysis so that an unetched area may occur. In the present invention, the amount of Cu mixed from an aluminum metal employed to obtain the above Fe content and Si content is about 5 to 100 ppm (0.0005 to 0.01%).

The effects of the present invention are not impaired if the content of unavoidable impurities is within a range that is normally observed in a commercially available aluminum metal. For example, the Ni content may be about 50 ppm, the V content may be about 200 ppm, the Cr content may be about 50 ppm, the Zr content may be about 40 ppm, the Mn content may be about 50 ppm, the B content may be about 10 ppm, and the Zn content may be about 50 ppm.

The aluminum alloy sheet for a lithographic printing plate according to the present invention is produced by casting an ingot of an aluminum alloy having the above composition by means of continuous casting or the like and subjecting the resulting ingot to homogenization, hot-rolling and cold-rolling. The present invention is characterized in that hot-rolling includes rough hot-rolling and finish hot-rolling, and recrystallized grains when winding the aluminum alloy sheet in the shape of a coil after finish hot-rolling are controlled by specifying the rough hot-rolling start temperature, the rolling finish temperature, the holding time from rough hot-rolling to finish hot-rolling, and the finish hot-rolling finish temperature, and cold-rolling the hot-rolled product to obtain a sheet material having a desired thickness without performing process annealing after finish hot-rolling.

Specifically, a non-uniform structure that may cause streaks is removed by facing the rolling-side surface layer of an ingot of an aluminum alloy having the above composition. The resulting product is subjected to a homogenization treatment at 500 to 610° C. for one hour or more. The homogenization treatment causes Fe and Si dissolved to supersaturation to uniformly precipitate. As a result, etch pits formed during electrolysis have a minute circular shape so that plate wear is improved. If the homogenization treatment temperature is less than 500° C., precipitation of Fe and Si may be insufficient. As a result, the pit pattern may become non-uniform. If the homogenization treatment temperature exceeds 610° C., the amount of Fe dissolved increases. As a result, the number of minute precipitates that serve as pit formation starting points decreases. If the homogenization treatment time is less than one hour, precipitation of Fe and Si may become insufficient, so that the pit pattern may become non-uniform.

Hot-rolling is normally performed in a hot-rolling line by subjecting the homogenized product to rough hot-rolling on a rough rolling stand, transferring the rolled sheet to a finish rolling stand, subjecting the rolled sheet to finish hot-rolling on the finish rolling stand, and winding the hot-rolled sheet in the shape of a coil. In the present invention, rough hot-rolling is started at 400 to 520° C. and finished at 400° C. or more. After completion of rough hot-rolling, the product subjected to rough hot-rolling is held for 60 to 300 seconds before starting finish hot-rolling on the finish rolling stand to recrystallize the surface of the product. The above Mg and Ga concentrations can be obtained by holding the product subjected to rough hot-rolling before starting finish hot-rolling. Specifically, the Mg and Ga concentrations can be adjusted so that the surface area of the aluminum alloy sheet up to a depth of 0.2 μm from the surface of the aluminum alloy sheet has an Mg concentration that is higher than the average Mg concentration by a factor of 5 to 50, and a Ga concentration that is higher than the average Ga concentration by a factor of 2 to 20.

If the rough hot-rolling start temperature is less than 400° C., the number of rolling passes may increase due to an increase in deformation resistance so that productivity may decrease. If the rough hot-rolling start temperature exceeds 520° C., coarse recrystallized grains may be produced during rolling so that a streak-shaped non-uniform structure may be obtained. If the rough hot-rolling finish temperature is less than 400° C., recrystallization due to holding after rough hot-rolling may become insufficient so that a uniform surface structure may not be obtained. Moreover, the above Mg and Ga concentrations may not be achieved. If the holding time from completion of rough hot-rolling to finish hot-rolling is less than 60 seconds, recrystallization may become insufficient, whereby a uniform surface structure may not be obtained. Moreover, the above Mg and Ga concentrations may not be achieved due to a small difference between the Mg concentration in the surface area and the average Mg concentration and a small difference between the Ga concentration in the surface area and the average Ga concentration. If the holding time exceeds 300 seconds, coarse recrystallized grains may be partially produced due to the growth of recrystallized grains, whereby minute recrystallized grains may not be obtained upon completion of hot-rolling. Moreover, the above Mg and Ga concentrations may not be achieved.

The product subjected to rough hot-rolling is subjected to finish hot-rolling. Finish hot-rolling is terminated at 330° C. or more, and the resulting product is wound in the shape of a coil. If the finish hot-rolling finish temperature is less than 330° C., recrystallization may occur only partially so that streaks may occur. The finish hot-rolling finish temperature is preferably 370° C. or less. If the finish hot-rolling finish temperature exceeds 370° C., recrystallized grains may become large so that streaks may occur.

The product subjected to hot-rolling is wound in the shape of a coil to obtain a hot-rolled product of which the surface area has an average recrystallized grain size of 50 μm or less in the direction perpendicular to the rolling direction. Therefore, a sheet material having a desired thickness can be obtained by cold-rolling the resulting product without performing process annealing after finish hot-rolling. An increase in productivity and a reduction in production cost can thus be achieved. Moreover, since the surface area of the final rolled sheet obtained by cold-rolling has an average recrystallized grain size of 50 μm or less in the direction perpendicular to the rolling direction, the surface quality of the printing plate can be made uniform.

A lithographic printing plate must have an appropriate strength so that the lithographic printing plate can endure deformation during transportation, tension that occurs when provided in a printer, a plate failure during printing, and the like. The reduction ratio during cold-rolling after hot-rolling is important to provide such a strength in addition to the alloy composition. It is desirable to adjust the reduction ratio during cold-rolling to 80% or more. If the reduction ratio during cold-rolling is less than 80%, the printing plate (printing plate support) may not be provided with sufficient strength so that deformation or a plate failure may occur. In order to provide the printing plate with necessary strength, it is desirable that the printing plate after cold-rolling have a tensile strength of 190 MPa or more.

The ink adhesion resistance of the final rolled sheet after cold-rolling can be improved by adjusting the arithmetic average roughness Ra of the surface of the sheet in the direction perpendicular to the rolling direction to 0.03 to 0.5 μm. If the arithmetic average roughness Ra is less than 0.03 μm, the water retention value of a dampening solution may rapidly decrease when the sheet is applied as a printing plate so that the ink in the image area may easily move to the non-image area (i.e., the ink-adhesion resistance may decrease). If the arithmetic average roughness Ra exceeds 0.3 μm, a blanket cylinder may be contaminated. In order to improve the ink-adhesion resistance, the sheet must have a surface roughness that ensures a sufficient water-retention value. Therefore, the arithmetic average roughness of the roughened surface is preferably 0.03 to 0.5 μm, and more preferably 0.2 to 0.4 μm.

In order to adjust the arithmetic average roughness Ra of the surface of the sheet in the direction perpendicular to the rolling direction to 0.03 to 0.5 μm, it is necessary to perform final cold-rolling using a work roll (WR) having an outer diameter of 250 to 700 mm and a surface roughness Ra of 0.03 to 0.6 μm in the direction perpendicular to the rolling direction, and adjust the reduction ratio during final cold-rolling, the rolling speed, the properties of the rolling oil, and the amount of the rolling oil supplied corresponding to the alloy composition.

In the aluminum alloy sheet according to the present invention, it is preferable to adjust the amount of aluminum powder on the surface of the rolled sheet after final cold-rolling to 0.1 to 3.0 mg/m$^2$. The term "aluminum powder" used herein refers to an aluminum alloy powder that is produced from the aluminum alloy rolled sheet during final cold-rolling and remains on the surface of the rolled sheet. In the aluminum alloy according to the present invention which contains Mg, if the amount of aluminum powder is less than 0.1 mg/m$^2$, an effect of preventing abrasion of a coil may be insufficient when the rolled sheet is wound as a coil after final cold-rolling. If the amount of aluminum powder exceeds 3.0 mg/m$^2$, the aluminum powder may not be removed sufficiently during a degreasing process and remain on the surface of the sheet, whereby the formation of pits may become insufficient or non-uniform in the area in which the aluminum powder remains during the electrolytic surface-roughening treatment and an inferior appearance due to an unetched area or an irregular pattern may occur after electrolytic graining. Moreover, excessive aluminum powder may contaminate the production line.

In order to adjust the amount of aluminum powder on the surface of the sheet after final cold-rolling to the above range, it is necessary to adjust the reduction ratio during final cold-rolling, the properties of the rolling oil, and the amount of rolling oil supplied corresponding to the composition. In particular, the viscosity of the rolling oil used for final cold-rolling is important. It is preferable to use a rolling oil with a viscosity of 1 to 6 cSt. If the viscosity is less than 1 cSt, since the amount of rolling oil introduced between the roll and the rolled sheet decreases, a lubrication failure occurs, whereby a large amount of aluminum powder tends to be produced. If the viscosity exceeds 6 cSt, since the amount of rolling oil introduced between the roll and the rolled sheet increases to a large extent, the amount of aluminum powder produced tends to decrease. The amount of aluminum powder may be measured as follows. As a quantitative analysis of residual powder on the surface of the sheet, a given area of the surface of the sheet is wiped off with an absorbent cotton immersed in a solvent, and the aluminum content of the absorbent cotton is measured.

As the rolling oil used during final cold-rolling, it is preferable to use a rolling oil that ensures that the Mg content (Mg %) of the aluminum alloy sheet and the viscosity p of the rolling oil satisfy the relationship "$\rho \leqq 2\times Mg\ \%+4$". If $\rho > (2\times Mg+4)$, the deformation resistance decreases. Moreover, since the amount of rolling oil introduced between the roll and the rolled sheet increases, a number of large pits tend to be formed.

In the present invention, the etch pits formed by the electrolytic surface-roughening treatment can be made more uniform by adjusting the number of oil pits with a diameter (circle equivalent diameter) of 30 μm or more formed in the surface of the aluminum alloy sheet after final cold-rolling to 50 or less per square millimeter (mm$^2$). Since the aluminum alloy according to the present invention contains Mg, large oil pits with a diameter of 30 μm or more tend to remain as large pits after electrolytic graining. If the number of such large pits exceeds 50 per square millimeter (mm$^2$), etch pits formed by the electrolytic surface-roughening treatment tend to become non-uniform.

In order to adjust the number of oil pits having a diameter (circle equivalent diameter) of 30 μm or more to 50 or less per square millimeter (mm$^2$), it is necessary to adjust the reduction ratio during final cold-rolling, the configuration of the roll, the properties of the rolling oil, and the amount of rolling oil supplied. When using an aluminum alloy which contains Mg and has a relatively high deformation resistance, it is preferable to use a roll having a roll surface with an arithmetic average roughness Ra of 0.2 to 0.5 μm during final cold-rolling and to perform cold-rolling using a rolling oil with a viscosity of 1 to 6 cSt.

If the roll surface has an arithmetic average roughness Ra of more than 0.5 μm, the oil film breaks due to an increase in local contact pressure in the contact arc length, so that the metal contact area increases. As a result, a lubrication failure tends to occur. If the arithmetic average roughness Ra is less than 0.2 μm, since the amount of rolling oil introduced between the roll and the rolled sheet increases to a large extent, the number of large oil pits may increase. If the viscosity of the rolling oil is less than 1 cSt, since the amount of rolling oil introduced between the roll and the rolled sheet decreases, a lubrication failure occurs. If the viscosity of the rolling oil exceeds 6 cSt, since the amount of rolling oil introduced between the roll and the rolled sheet increases to a large extent, the number of large oil pits may increase. The number of oil pits may be measured as follows. After degreasing and washing the surface of the aluminum alloy sheet, the surface of the aluminum alloy sheet is observed using a scanning electron microscope (SEM) at a magnification of 500. The number of oil pits and their distribution are measured by an intercept method.

EXAMPLES

The present invention is described below by way of examples and comparison examples to demonstrate the effects of the present invention. Note that the following examples illustrate a preferred embodiment of the present invention. The present invention is not limited to the following examples.

Example 1 and Comparative Example 1

An aluminum alloy having the composition shown in Table 1 was melted and cast. Each rolling-side surface of the resulting ingot was faced by 5 mm to reduce the thickness of the ingot to 500 mm. The ingot was then subjected to homogenization and hot-rolling, followed by finish hot-rolling to achieve a given thickness. The aluminum alloy was then wound in the shape of a coil. The hot-rolled product was cold-rolled to a thickness of 0.3 mm without performing process annealing. In Tables 1 and 2, values outside the conditions according to the present invention are underlined.

TABLE 1

| | Chemical composition | | | | | |
|---|---|---|---|---|---|---|
| Alloy | Ga | Fe | Si | Cu | Ti | Mg |
| A | 122 | 0.28 | 0.10 | 0.000 | 0.006 | 0.07 |
| B | 100 | 0.30 | 0.07 | 0.015 | 0.030 | 0.30 |
| C | 135 | 0.30 | 0.06 | 0.016 | 0.029 | 0.08 |
| D | 285 | 0.40 | 0.10 | 0.004 | 0.025 | 0.70 |
| E | 10 | 0.45 | 0.05 | 0.010 | 0.006 | 0.11 |
| F | 350 | 0.45 | 0.05 | 0.010 | 0.006 | 0.10 |

Note:
the Ga content is indicated in ppm. The unit for other components is mass %

TABLE 2

| Production condition | Homogenization Temp. (° C.) | Homogenization Time (h) | Rough hot rolling start temperature (° C.) | Rough hot rolling finish temperature (° C.) | Holding time (sec) | Finish hot rolling finish temperature (° C.) | Cold reduction ratio (%) |
|---|---|---|---|---|---|---|---|
| a | 540 | 3 | 455 | 460 | 100 | 345 | 90 |
| b | 590 | 2 | 470 | 475 | 80 | 365 | 90 |
| c | 500 | 5 | 430 | 430 | 260 | 340 | 90 |
| d | 530 | 4 | 460 | 465 | 360 | 355 | 90 |
| e | 560 | 3 | 450 | 450 | 40 | 340 | 90 |
| f | 610 | 3.5 | 410 | 390 | 130 | 315 | 90 |
| g | 480 | 5.5 | 460 | 470 | 120 | 330 | 90 |
| h | 540 | 3 | 460 | 470 | 90 | 345 | 93 |
| i | 600 | 2 | 480 | 490 | 70 | 360 | 94 |
| j | 550 | 5 | 450 | 460 | 100 | 355 | 75 |

The average recrystallized grain size in the surface area of the cold-rolled sheet (specimen) in the direction perpendicular to the rolling direction was measured. The Ga and Mg concentrations and the Mg precipitation rate in the surface area were evaluated. The results are shown in Table 3. In Table 3, a value outside the condition according to the present invention is underlined.

Measurement of average recrystallized grain size: After degreasing and washing the surface of the specimen, the surface of the specimen was mirror-polished, and anodized using Parker's reagent. The crystal grains were observed using an optical microscope (polarization mode), and the crystal grain size in the direction perpendicular to the rolling direction was determined using an intercept method.

Measurement of Ga and Mg concentrations in surface area: The Ga and Mg concentrations in the surface area and the Ga and Mg concentrations in the inner area were compared by performing Ga and Mg depth analysis (depth profile measurement) by secondary ion mass spectrometry (SIMS), and calculating the ratio of the highest Ga and Mg concentration counts in the surface area to the highest Ga and Mg concentration counts from the inside of the aluminum matrix.

Measurement of Mg precipitation rate: The Mg content in the intermetallic compounds was determined by a phenol residue analysis method shown in FIG. 1, and the Mg precipitation rate was calculated by "[(Mg content (wt %) in intermetallic compounds)/(average Mg content (wt %))]×100(%)".

TABLE 3

| Specimen | Alloy | Production condition | Average grain size (μm) | Ga concentration (factor) | Mg concentration (factor) | Remarks: Mg precipitation amount (%) | Remarks: Mg dissolution amount (%) |
|---|---|---|---|---|---|---|---|
| 1 | A | a | 38 | 5 | 8 | 0.0091 | 0.061 |
| 2 | B | b | 43 | 4 | 11 | 0.12 | 0.180 |
| 3 | C | c | 40 | 24 | 20 | 0.012 | 0.068 |
| 4 | C | a | 33 | 10 | 35 | 0.028 | 0.052 |
| 5 | D | a | 30 | 7 | 30 | 0.385 | 0.315 |
| 6 | E | b | 45 | 3 | 45 | 0.0165 | 0.094 |
| 7 | F | c | 36 | 6 | 18 | 0.02 | 0.080 |
| 8 | A | d | 73 | 40 | 55 | 0.0525 | 0.018 |
| 9 | A | e | 84 | 1.2 | 3 | 0.007 | 0.063 |
| 10 | A | f | Not recrystallized | 7 | 2 | 0.0105 | 0.060 |
| 11 | A | g | 95 | 15 | 22 | 0.028 | 0.042 |
| 12 | A | h | 34 | 6 | 9 | 0.0089 | 0.061 |
| 13 | A | i | 30 | 3 | 6 | 0.019 | 0.051 |
| 14 | A | j | 40 | 4 | 8 | 0.018 | 0.052 |

The tensile strength of the specimen (cold-rolled product) was measured. The presence or absence of a non-uniform pattern and the presence or absence of streaks on the specimen (cold-rolled product) were observed, and an unetched area and etch pit uniformity were evaluated by the following methods. The results are shown in Table 4. In Table 4, a value outside the condition according to the present invention is underlined.

The cold-rolled product was subjected to degreasing (solution: 5% sodium hydroxide, temperature: 60° C., time: 10 seconds), neutralization (solution: 10% nitric acid, temperature: 20° C., time: 30 seconds), an alternating-current electrolytic surface-roughening treatment (solution: 2.0% hydrochloric acid, temperature: 25° C., frequency: 50 Hz, current density: 60 A/dm$^2$, time: 20 seconds), a desmut treatment (solution: 5% sodium hydroxide, temperature: 60° C., time: 5 seconds), and an anodizing treatment (solution: 30% sulfuric acid, temperature: 20° C., time: 60 seconds). The product was then washed with water, dried, and cut to a specific size to prepare a specimen.

The presence or absence of a non-uniform pattern and the presence or absence of streaks on each specimen were observed. The surface of the specimen was observed using a scanning electron microscope (SEM) at a magnification of 500. The surface of the specimen was photographed so that the field of view was 0.04 mm$^2$. An unetched area and etch pit uniformity were evaluated from the resulting photograph.

Presence or absence of non-uniform pattern: A case where a non-uniform pattern was observed on the surface of the specimen with the naked eye was evaluated as "Bad", and a case where a non-uniform pattern was not observed was evaluated as "Good".

Presence or absence of streaks: A case where streaks were observed on the surface of the specimen with the naked eye was evaluated as "Bad" and a case where streaks were not observed was evaluated as "Good".

Evaluation of unetched area. A case where the percentage of an unetched area was more than 20% was evaluated as "Bad", a case where the percentage of an unetched area was more than 10% and 20% or less was evaluated as "Good" and a case where the percentage of an unetched area was 10% or less was evaluated as "Excellent".

Evaluation of etch pit uniformity: A case where the area ratio of large pits with a circle equivalent diameter exceeding 10 μm was more than 10% with respect to all pits was evaluated as "Bad", a case where the area ratio was more than 5% and 10% or less was evaluated as "Good" and a case where the area ratio was 5% or less was evaluated as "Excellent".

Tensile strength: A JIS-5 specimen was obtained from the cold-rolled product and subjected to a tensile test. A case where the tensile strength of the specimen was more than 200 MPa was evaluated as "Excellent", a case where the tensile strength of the specimen was 190 MPa or more and less than 200 MPa was evaluated as "Good" and a case where the tensile strength of the specimen was less than 190 MPa was evaluated as "Bad".

TABLE 4

| Specimen | Unetched area | Pit uniformity | Non-uniform pattern | Streaks | Tensile strength (MPa) | Tensile strength Evaluation |
|---|---|---|---|---|---|---|
| 1 | Excellent | Excellent | Good | Good | 195 | Good |
| 2 | Good | Good | Good | Good | 201 | Excellent |
| 3 | Good | Good | Good | Good | 198 | Good |
| 4 | Good | Good | Good | Good | 199 | Good |
| 5 | Bad | Bad | Bad | Bad | 220 | Excellent |
| 6 | Bad | Bad | Good | Good | 200 | Excellent |
| 7 | Bad | Bad | Good | Good | 190 | Good |
| 8 | Good | Good | Bad | Bad | 195 | Good |
| 9 | Good | Good | Bad | Bad | 196 | Good |
| 10 | Good | Bad | Bad | Bad | 193 | Good |
| 11 | Bad | Bad | Good | Good | 199 | Good |
| 12 | Good | Good | Good | Good | 200 | Excellent |
| 13 | Good | Good | Good | Good | 210 | Excellent |
| 14 | Good | Good | Good | Good | 160 | Bad |

As shown in Table 4, Specimens 1 to 4, 12 and 13 according to the present invention did not produce a non-uniform pattern and streaks, exhibited excellent etching properties after electrolysis and had uniform etch pits over the entire surface.

On the other hand, Specimen 5 had a poor surface quality due to a high Mg content. Specimen 6 could not be sufficiently surface-roughened due to a low Ga content. Moreover, pit uniformity deteriorated. Specimen 7 produced an unetched area during the surface-roughening treatment due to a high Ga content.

Since Specimen 8 was produced with a long holding time from completion of rough hot-rolling to finish hot-rolling, coarse recrystallized grains were partially produced due to the growth of recrystallized grains, so that minute recrystallized grains could not be obtained at the time of completion of hot-rolling. Moreover, the given Ga and Mg concentrations were not achieved. Since Specimen 9 was produced with a short holding time from completion of rough hot-rolling to finish hot-rolling, a uniform recrystallized structure could not be obtained in the surface area of the sheet material due to insufficient recrystallization. Moreover, the given Ga and Mg concentrations were not achieved. As a result, a non-uniform pattern and streaks were observed.

Specimen 10 produced a non-uniform pattern and streaks since the finish hot-rolling finish temperature was low and a non-recrystallized area occurred due to insufficient recrystallization. Specimen 10 also showed pit non-uniformity during electrolysis. Since Specimen 11 was homogenized at a low temperature, precipitation of Fe and Si was insufficient, so that the pit pattern formed during electrolysis was non-uniform, and an unetched area was observed.

Specimen 14 had a tensile strength of less than 190 MPa (i.e., could not be provided with the strength necessary for a printing plate) due to a low reduction ratio during cold-rolling. Therefore, deformation or a plate failure may occur.

Although only some embodiments of the invention have been described in detail above, those skilled in the art would readily appreciate that many modifications are possible in the embodiments without materially departing from the novel teachings and advantages of the invention. Accordingly, such modifications are intended to be included within the scope of the invention.

What is claimed is:

1. An aluminum alloy sheet for a lithographic printing plate, said aluminum alloy sheet being produced by cold-rolling a hot-rolled product without performing process annealing and comprising 0.03 to 0.15 mass % of Si, 0.2 to 0.7 mass % of Fe, 0.05 to 0.5 mass % of Mg, 0.003 to 0.05 mass % of Ti, and 30 to 300 ppm of Ga, with the balance being aluminum and inevitable impurities, a surface area of the aluminum alloy sheet having an average recrystallized grain size of 50 μm or less in a direction perpendicular to a rolling direction, an Mg concentration that is higher than the average Mg concentration by a factor of 5 to 50, and a Ga concentration that is higher than the average Ga concentration by a factor of 2 to 20, the surface area being an area up to a depth of 0.2 μm from the surface of the aluminum alloy sheet, the % being mass %.

2. The aluminum alloy sheet according to claim 1, further comprising greater than 0% but no more than 0.05% of Cu.

3. The aluminum alloy sheet according to claim 1, wherein the content of Mg that precipitates in the matrix of the aluminum alloy sheet is 50% or less of the average Mg concentration.

4. The aluminum alloy sheet according to claim 1, the aluminum alloy sheet having a tensile strength of 190 MPa or more.

* * * * *